US007791499B2

(12) United States Patent
Mohan et al.

(10) Patent No.: US 7,791,499 B2
(45) Date of Patent: Sep. 7, 2010

(54) DYNAMIC SIREN DETECTION AND NOTIFICATION SYSTEM

(75) Inventors: Glenn Andrew Mohan, Burnaby (CA); Phillip Alan Hetherington, Port Moody (CA)

(73) Assignee: QNX Software Systems Co., Ottawa, Ontario (CA)

( * ) Notice: Subject to any disclaimer, the term of this patent is extended or adjusted under 35 U.S.C. 154(b) by 282 days.

(21) Appl. No.: 12/014,686

(22) Filed: Jan. 15, 2008

(65) Prior Publication Data

US 2009/0179774 A1 Jul. 16, 2009

(51) Int. Cl.
*G08G 1/00* (2006.01)

(52) U.S. Cl. ..... 340/902; 340/692; 340/384.4; 701/301

(58) Field of Classification Search ..... 340/902, 340/692, 691.6, 384.1, 384.4, 404.1, 933, 340/904, 905; 701/213, 301; 381/86
See application file for complete search history.

(56) References Cited

U.S. PATENT DOCUMENTS

| | | | | |
|---|---|---|---|---|
| 4,952,931 | A * | 8/1990 | Serageldin et al. | 340/902 |
| 5,710,555 | A | 1/1998 | McConnell et al. | 340/916 |
| 5,719,551 | A * | 2/1998 | Flick | 340/426.25 |
| 6,133,849 | A | 10/2000 | McConnell et al. | 340/825.72 |
| 6,362,749 | B1 * | 3/2002 | Brill | 340/902 |
| 7,245,232 | B1 | 7/2007 | Caouette, Sr. | 340/933 |
| 2002/0150262 | A1 * | 10/2002 | Carter | 381/86 |

* cited by examiner

*Primary Examiner*—Toan N Pham
(74) *Attorney, Agent, or Firm*—Brinks Hofer Gilson & Lione

(57) ABSTRACT

A monitoring and notification system detects and informs vehicle occupants of sirens. The system may adjust radio, phone, or other device settings in the vehicle in conjunction with the notification. The notification may take an audible or visual form, and the monitoring system may perform its analysis across multiple types of sirens. In addition, the system may adapt its processing based on location to take into account locally expected siren formats.

23 Claims, 10 Drawing Sheets

| Siren Signal Format | | |
|---|---|---|
| Siren Name | Siren Content | Siren Duration |
| ALERT 202 | 670 Hz Steady Tone | 3 minutes |
| ATTACK 204 | 740 Hz Tone, ramping up and down, :06 up and :05 down | 6 sec. up and 5 sec. down for 3 minutes |
| HI / LO 206 | 550 Hz Tone alternating with a 740 Hz Tone | 0.75 sec. duration per tone for 3 minutes |
| AIR-HORN 208 | 740 Hz Tone | 2 sec. on, 2 sec. off for 3 minutes |
| FIRE 210 | 740 Hz Tone, ramping up and down, minimum during down ramp | 16 sec. up base, down for 1.5 minutes |
| GROWL 212 | 533 Hz Tone burst with fade up and down | 0.5 sec. (for siren test) |
| HAZARD 214 | 500 Hz Tone ramping up to 850 Hz | 1 sec. repeating for 3 minutes |
| CHIME 216 | 533 Hz Tone bursts | 2 sec. intervals of 6 cycles |
| SCREAM 218 | 850 Hz Tone, ramping down to 500 Hz, then back up to 850 Hz | 0.8 sec. down, 0.2 sec. up for 3 minutes |
| WAIL 220 | 850 Hz Tone, ramping down to 500 Hz, then back up to 850 Hz | 0.8 sec. down, 0.2 sec. up for 3 minutes |

200

Figure 2

DYNAMIC SIREN DETECTION AND NOTIFICATION SYSTEM

BACKGROUND OF THE INVENTION

1. Technical Field

This disclosure relates to signal processing systems, and in particular, to a system that detects a siren and provides a siren notification.

2. Related Art

Rapid developments in modern technology have led to the widespread adoption of car phones, hi-fidelity car stereo systems, and vehicle multi-media systems. These systems greatly increase passenger and driver comfort, convenience, and enjoyment of the vehicle. At the same time, the driver and passengers must take care to remain alert to surrounding circumstances. For example, when the stereo system is playing at a high volume, it may be difficult to hear the warning siren of an approaching emergency vehicle. In general, increased cognitive loading from any source such as excessive background noise, listening to loud music, or engaging in conversation, may result in greater response times to changes in the driving environment.

Complicating the issue is that there are many different types of warning sirens in use in many different locations around the world. In other words, there is no widely accepted and completely consistent implementation of warning siren content. Accordingly, even if a vehicle occupant was fully aware of all external environmental sounds, the lack of signal standardization would frustrate recognition of any given sound as a warning siren.

Therefore, a need exists for a siren detection system that addresses the concerns noted above and other previously encountered.

SUMMARY

A siren detection and notification system provides notification of nearby sirens. When used in a vehicle such as an automobile, the siren detection and notification system may adjust radio, phone, or other device settings in the vehicle. For example, the system may reduce the radio volume. In conjunction with the adjustment, the system may provide a notification of siren detection to the passengers. The notification may take an audible, visual, or other form, and the system may perform its analysis across multiple types of sirens. The system may engage in a dynamic analysis based on location.

In one implementation, a siren detection and notification system includes a vehicle bus interface, a memory, and a processor. The memory stores a siren model, a vehicle environment sound signal, and a siren processing program. The siren processing program analyzes the vehicle environment sound signal with respect to the siren model to determine whether a siren sound is detected in the vehicle environment sound signal. The siren processing program also issues a vehicle system control command (e.g., a radio volume attenuation command) over the vehicle bus interface when the siren sound is detected in the vehicle environment sound signal. The processor executes the siren processing program.

In another implementation, the memory stores multiple geographical location siren models. Each siren model may characterize siren signal content applicable in any particular geographic region (e.g., France and Spain, or Illinois and Iowa). The siren processing program analyzes a vehicle location to select between the geographical location siren models, thereby obtaining a selected geographical location siren model. The siren processing program also analyzes the vehicle environment sound signal with respect to the selected geographical location siren model to detect whether a siren sound is present in the vehicle environment sound signal. When the siren sound is detected, the siren processing program issues a siren detection notification (e.g., makes an audible announcement or illuminates a warning indicator).

The system may also include echo suppression logic that obtains a source reference signal prior to audible reproduction and that suppress the source reference signal in a vehicle environment sound signal to obtain a siren analysis signal. A signal sensor such as a microphone may obtain the vehicle environment sound signal. The siren processing system may then analyze the siren analysis signal with respect to the siren model to determine whether a siren sound is detected in the siren analysis signal.

Other systems, methods, features and advantages will be, or will become, apparent to one with skill in the art upon examination of the following figures and detailed description. All such additional systems, methods, features and advantages are included within this description, are within the scope of the claimed subject matter, and are protected by the following claims.

BRIEF DESCRIPTION OF THE DRAWINGS

The systems may be better understood with reference to the following drawings and description. The elements in the figures are not necessarily to scale, emphasis instead being placed upon illustrating the principles of the capability analysis techniques. In the figures, like-referenced numerals designate corresponding parts throughout the different views.

FIG. 2 shows a siren model table.

DETAILED DESCRIPTION OF THE PREFERRED EMBODIMENTS

Figure 1:
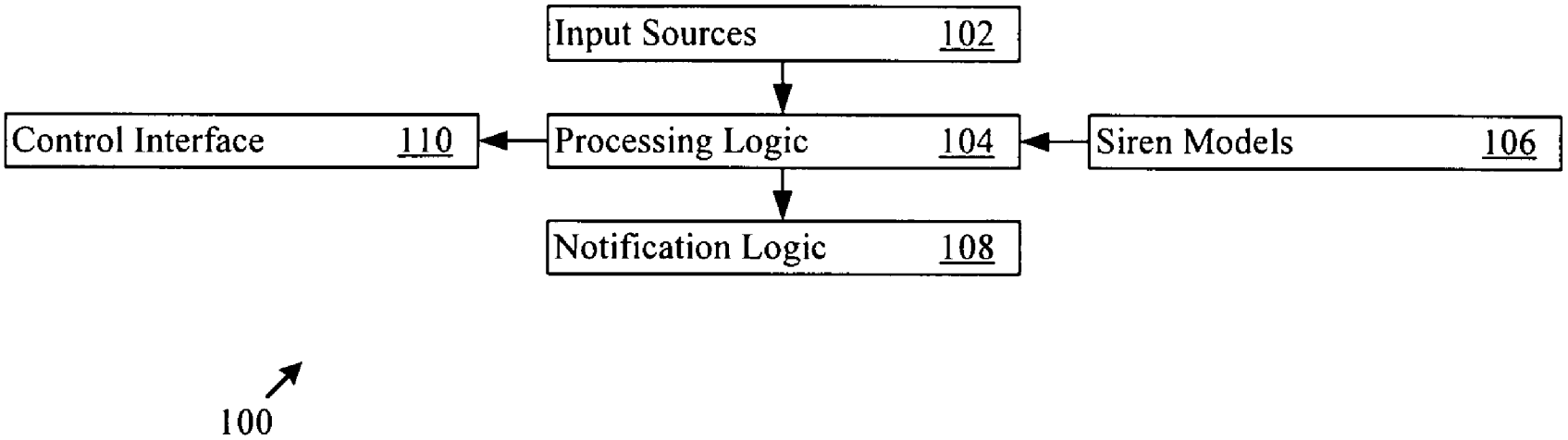
FIG. 1 shows a siren detection and notification system.

FIG. 1 shows a dynamic siren detection and notification system 100. As an overview, the system 100 includes input sources 102 that provide data to the processing logic 104. The input sources 102 may include a microphone, microphone array, or other vehicle environment sensor; a satellite positioning system, dead-reckoning system, or other vehicle location system; or other input sources. The processing logic 104 analyzes the data obtained from the input sources 102 to detect and notify vehicle occupants of sirens.

To that end, the processing logic 104 accesses the siren models 106. The siren models 106 include information that characterizes one or more sirens, such as police sirens, fire department sirens, ambulance sirens, public warning or emergency sirens, or any other type of warning signal. Examples of characteristics that the siren models may store or represent include frequency content and changes in frequency content (e.g., stored in a spectrogram template or other representation); change, rate of change, or duration of frequency or time characteristics of a siren; amplitude, relative amplitude between portions of the siren in time or frequency; or other characteristics. The siren models 106 may span any number of different geographical areas. Each siren model may include geographical identifier that specifies for which geographical region or regions any given siren model is applicable. The geographical identifier may be satellite positioning system coordinates; latitude or longitude coordinates; city, state, country, region, county, area, roadway, facility (e.g., industrial, nuclear, or petrochemical plant) or other geographical area identifier; or any other type of coordinates or range of coordinates.

When the processing logic 104 recognizes a particular siren, the processing logic 104 takes a preconfigured action. As one example, the processing logic 104 may issue a siren detection notification using the notification logic 108. The notification logic 108 may be an indicator light, tone or alarm, audible announcement, or another type of notification.

Alternatively or additionally, the processing logic 104 may take action through the control interface 110. For example, the control interface 110 may be a vehicle bus interface, or other direct or indirect connection to other processing modules in the vehicle. In the case of a vehicle bus interface, the processing logic 104 may issue vehicle system control commands through the vehicle bus interface to any processing module also connected to the bus interface. In one implementation, the processing logic 104 communicates a volume control command to an audio electronics module. The volume control command may direct the audio electronics module to reduce the audio output volume so that the detected siren may more easily be heard by vehicle passengers. The processing logic 104 may also apply command decision filters to determine whether or not to send any particular vehicle control command. One example of a command decision filter is to suppress volume control commands when a hands-free phone call is in progress. Another example of a command decision filter is to suppress volume control commands when radio, CD, DVD, or other entertainment system volume is already below a loudness threshold.

FIG. 2 shows a siren model table 200. The siren model table 200 gives examples of sirens that are applicable for the United States. The siren model table 200 includes the following sirens, their content, and their durations: the Alert siren 202, Attack siren 204, Hi/Lo siren 206, Air-Horn siren 208, and Fire siren 210. The siren model table 200 also includes the following additional sirens: the Growl siren 212, the Hazard siren 214, the Chime siren 216, the Scream siren 218, and the Wail siren 220. Table 1, below, and FIG. 2 explain the siren content and duration of each siren 202-220.

Taking a specific example from Table 1, the Hazard siren 214 is characterized by a 500 Hz tone that ramps up to 850 Hz, with a one second 'on' duration repeated over 3 minutes. The siren models 106 characterize the sirens that the processing logic 104 attempts to match.

Figure 3:
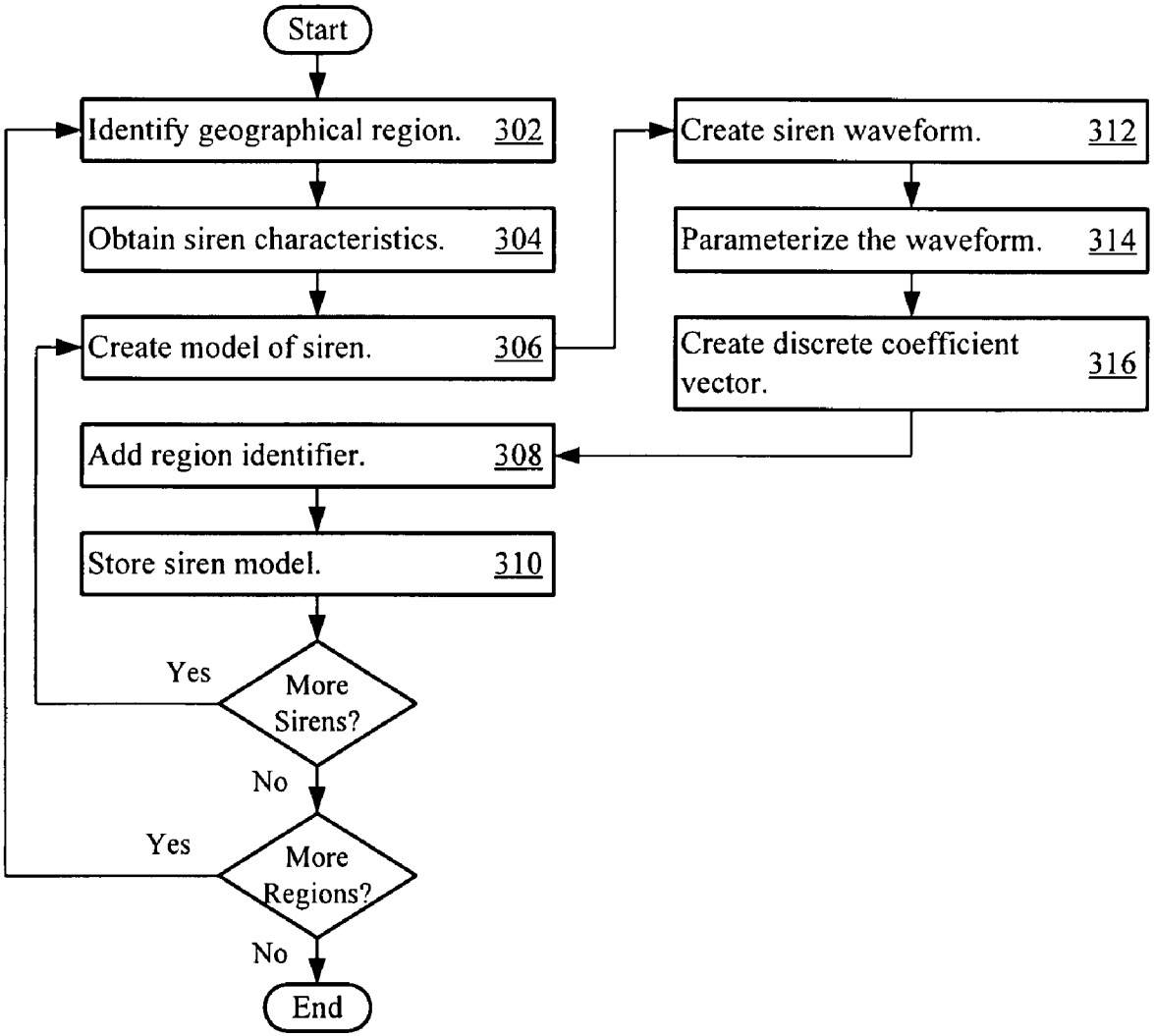
FIG. 3 shows processing flow for generating siren models.

FIG. 3 shows processing flow 300 for generating the siren models 106. The processing flow 300 may be executed by the system 100, or by a separate system that prepares siren models 106 for the system 100. The system identifies a particular geographical region. The geographical region may be one in which the vehicle is expected to operate, for example. Given the geographical region, the system obtains siren characteristics for that geographical region. To that end, the system may consult official government information sources, industry specific siren definitions, or any other source of siren characteristic information.

The system then creates a model of a siren applicable to the selected geographical region. For example, with regard to the Scream siren 218, the system may create the siren waveform by generating a sign wave sweep from Fmax=850 Hz to Fmin=500 Hz. During the sweep, the amplitude is held constant, the ramp down time is set to 0.8 seconds, and the ramp up time is set to 0.2 seconds.

After creating the siren waveform, the system may then parameterize the waveform. As one example, the system may determine discrete coefficients of the waveform and creates a discrete coefficient vector that characterizes the waveform. The discrete coefficients may be chosen by sampling the waveform at specific intervals (e.g., at twice the maximum frequency in the waveform). One benefit of employing the discrete coefficient representation is compression of the waveform into a significantly reduced memory footprint for accurately representing the waveform. However, other representations may be used. For example the system may alternatively or additionally store the siren models as spectrogram templates, waveform defining equations, or with other representations.

The system may add a region identifier to the discrete coefficient vector. The siren model is thereby tagged with the particular geographical region in which the siren is expected to be encountered. Each siren model may be tagged with any number of geographical region identifies. The system then stores each siren model for future reference. The system may

TABLE 1

Siren Signal Format

| Siren Name | Siren Content | Siren Duration |
|---|---|---|
| Alert | 670 Hz Steady Tone | 3 minutes |
| Attack | 740 Hz Tone, ramping up and down, :06 up and :05 down | 6 sec. up and 5 sec. down for 3 minutes |
| Hi/Lo | 550 Hz Tone alternating with a 740 Hz Tone | 0.75 sec. duration per tone for 3 minutes |
| Air-Horn | 740 Hz Tone | 2 sec. on, 2 sec. off for 3 minutes |
| Fire | 740 Hz Tone, ramping up and down, minimum during down ramp | 16 sec. up base, down for 1.5 minutes |
| Growl | 533 Hz Tone burst with fade up and down | 0.5 sec. (for siren test) |
| Hazard | 500 Hz Tone ramping up to 850 Hz | 1 sec. repeating for 3 minutes |
| Chime | 533 Hz Tone bursts | 2 sec. intervals of 6 cycles |
| Scream | 850 Hz Tone, ramping down to 500 Hz, then back up to 850 Hz | 0.8 sec. down, 0.2 sec. up for 3 minutes |
| Wail | 850 Hz Tone, ramping down to 500 Hz, then back up to 850 Hz | 0.8 sec. down, 0.2 sec. up for 3 minutes |

continue to create siren models for each siren expected to be encountered in the geographical region. As one example, the system may create siren models for ambulances, police vehicles, and fire department vehicles within the selected geographical region. The system may also create siren models for each geographical region through which the vehicle is expected to travel. For example, system may create siren models for regions throughout Italy, France, and Spain.

Figure 4:
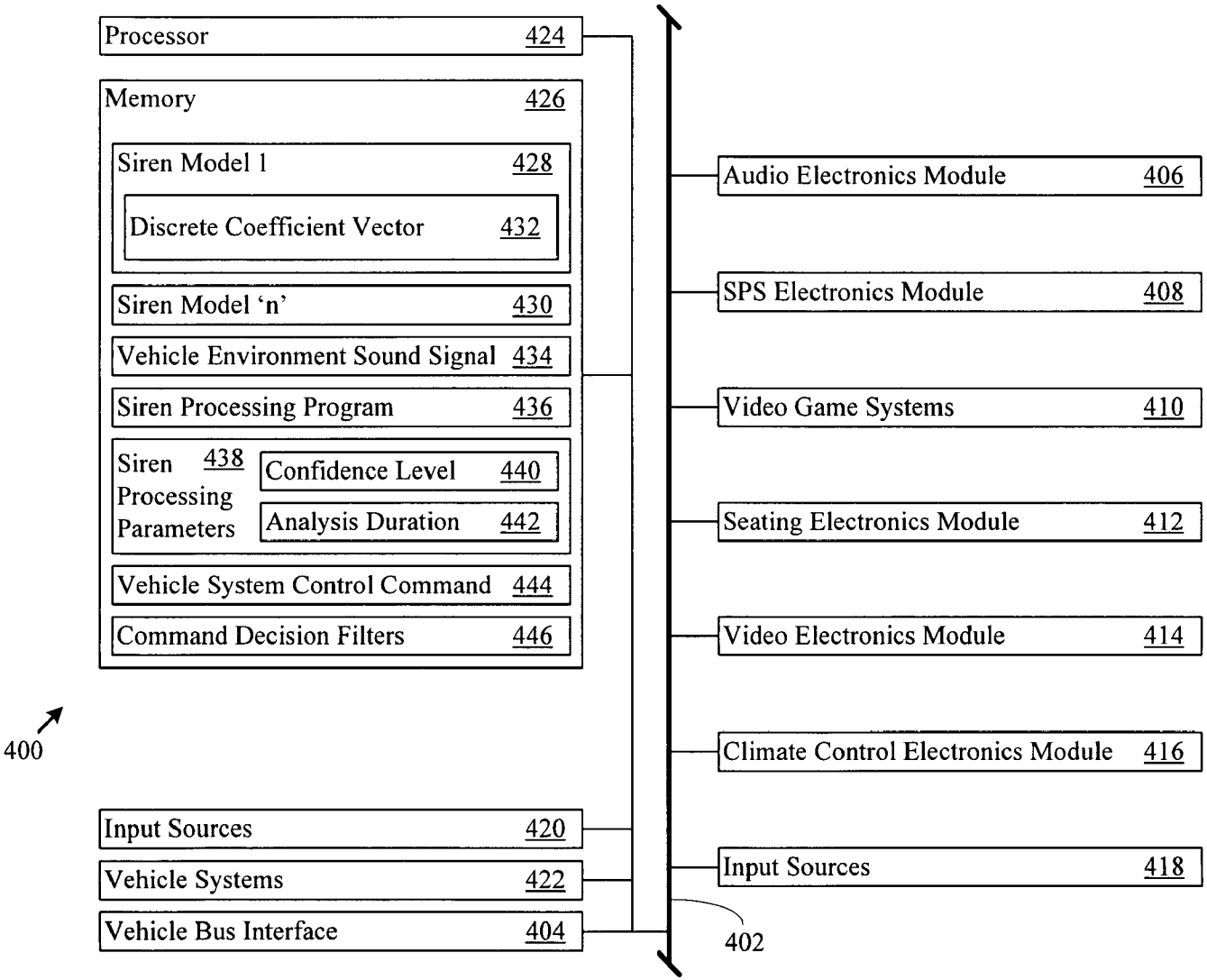
FIG. 4 shows a siren detection and notification system.

FIG. 4 shows a dynamic siren detection and notification system 400 ("system 400") connected to a vehicle bus 402 through the vehicle bus interface 404. The vehicle bus 402 may interconnect a diverse array of vehicle electronics modules. The vehicle bus interface 404 may include logic that sends or receives information to and from the modules 406-418 and the system 400 through the vehicle bus 402. The vehicle bus interface 404 may process data (e.g., bus packets containing vehicle control commands) transmitted over the vehicle bus 402. The vehicle bus interface 404 and vehicle bus 402 may adhere to bus architectures such as the Local Interconnect Network (LIN), Controller Area Network (CAN), J1939, ISO11783, FlexRay, Media Oriented Systems Transport (MOST), Keyword Protocol 2000 (KWP2000), Vehicle Area Network (VAN), DC-BUS, IDB-1394, or SMARTwireX architectures.

As examples, the vehicle electronics modules shown in FIG. 4 include a vehicle entertainment module 404, an audio electronics module 406, a Satellite Positioning System (SPS) electronics module 408, and video game systems 410. The modules also include a seating electronics module 412, a video electronics module 414, and a climate electronics module 416. Such modules may be connected to the system 400 over the vehicle bus 402, or as represented by the vehicle systems 422, by a different connection, such as a direct, local, integrated or other type of connection to the system 400.

The system 400 may receive operator input from directly connected input sources 420, or vehicle bus connected input sources 418. The input sources 418 and 420 may include buttons, joysticks, rotational or translational controls located on the dashboard, steering wheel, or in other locations; voice recognition systems employing one or more microphones, headsets, or other input devices; wireless receivers (e.g., for receiving inputs from a remote vehicle monitoring facility); or any other operator input source.

The audio electronics module 406 may include media access, control, and sound reproduction logic such as physical media access mechanisms, amplifiers and speakers for a CD player, SACD player, tape player, MP3 player, carphone (e.g., a hands-free car phone system), or other audio device. The SPS electronics module 408 may include a satellite positioning information receiver, location determination logic, location displays, announcement logic (e.g., speakers and audio signal reproduction logic to announce upcoming turns or points of interest), or other SPS processing logic. The video game systems 410 may include audio/visual reproduction logic and operator inputs for controlling a video game.

The seating electronics module 412 may control seat functions. Examples of seat functions include seat heating, seat cooling, seat positioning (e.g., forward, back, up, and down), lumbar support activation, massage or vibration mechanisms, or other electronic seat controls. The video electronics module 414 may include media access, control, and video and audio reproduction logic for a DVD player, video tape player, or other video device. The climate control electronics module 416 may include control logic for air conditioning functions, heating functions, front and rear window defogging, single or multiple zone temperature selection, window opening/closing, interior lighting, or other vehicle environment features.

The dynamic siren detection and notification system 400 includes a processor 424 connected to a memory 426. The memory 426 stores one or more siren models, such as the siren model 428 and the siren model 430. The siren model 428 encodes a siren waveform in a discrete coefficient vector 432, however, other siren waveform representations may be employed additionally or alternatively.

The memory 426 stores a vehicle environment sound signal 434. The input sources 418 and 420 may provide the vehicle environment sound signal 434 in analog or digital form. As examples, the input sources 418 and 420 may include microphones or microphone arrays, and may sample the ambient sounds within the vehicle. The processor 424 or other sampling logic may convert an analog sound signal to digital form and store the samples in the memory 426 as the vehicle environment sound signal 434.

The siren processing program 436 analyzes the vehicle environment sound signal 434 against the siren models 428-430. In that regard, the siren processing program 436 may operate according to siren processing parameters 438. Examples of siren processing parameters include a confidence level parameter 440 and an analysis duration parameter 442. The confidence level parameter 440 may specify the degree of confidence (e.g., 80%) needed that vehicle environment sound signals match any given siren model, and may help reduce the possibility of false positive matches to a siren model. The analysis duration parameter may specify the length of time (e.g., 5 second) over which the siren processing program determines a confidence measure, for example by continuing to analyze incoming vehicle environment sound signals against the siren models 428-430. Thus, for example, the siren processing program 436 may repeatedly analyze vehicle environment sound signals received over time against the siren models 428-430 to build a confidence measure over 5 seconds and determine whether the confidence measure exceeds 80%. Other examples of parameters include: how frequently to check for sirens (e.g., once per minute or continuously) and whether to disable siren detection.

In the event that the siren processing program 436 detects a siren, the siren processing program 436 may issue a vehicle system control command 444. One alternative is that the siren processing program 436 issues the vehicle system control command 444 through the vehicle bus interface 404 to one or more of the vehicle electronics modules 406-416. However, the siren processing program 436 may instead issue the vehicle system control command 444 to locally connected vehicle system 422.

Table 2 shows examples of vehicle system control commands 444 that the system 400 may employ to directly or indirectly signal, notify, advise, or aid recognition by the vehicle passengers that a siren signal has been detected. The system 400 may send additional, fewer, or different vehicle system control commands.

TABLE 2

| Vehicle System Control Commands | |
|---|---|
| Command | Example |
| Mute | Disable audio output - may be sent to the audio electronics module, SPS electronics module, video game systems, video electronics module, or other modules. |
| Reduce Volume | Lower audio output by a specified amount, to a specified amount, or to no greater than a specified amount, optionally for a specified duration - may be sent to the audio electronics module, SPS electronics module, video game systems, video electronics module, or other modules. |
| Illuminate Indicator | Activate a light, display, or other indicator that signals that a siren has been detected - may be sent to a head unit control module that controls dashboard indicators, or SPS, video game, or video electronics modules to instruct that a notification message be displayed on a screen. |
| Audible Announcement | Generate a specified audio signal - may be sent to the audio electronics module, SPS electronics module, video game systems, video electronics module, or other modules. |
| Activate Seat Vibration | Activate a seat vibration function - may be sent to the seating electronics module, or other modules. |
| Activate Climate Control | Activate a heater or air conditioner - may be sent to the climate control electronics module, or other modules. |

The siren processing program 436 may also exercise control over whether or not to send a vehicle system control command. To that end, the siren processing program may employ command decision filters 446 that affect whether or not the siren processing program 436 sends the vehicle system control command. The command decision filters 446 may take the form of logical tests. Examples of command decision filters 446 are shown below in Table 3.

TABLE 3

| Command Decision Filters | |
|---|---|
| Filter | Example |
| Hands-Free | If a hands-free phone call is in progress, do not send a Mute or Reduce Volume command. |
| Low Volume | If the current audio system volume is below a pre-determined threshold, do not send a Mute or Reduce Volume command. |
| High Volume | If the current ambient noise level (e.g., including audio generated by the stereo system) is above a pre-determine threshold, send multiple commands to multiple systems, including an Activate Seat Vibration Command and a Reduce Volume command. |

Figure 5:
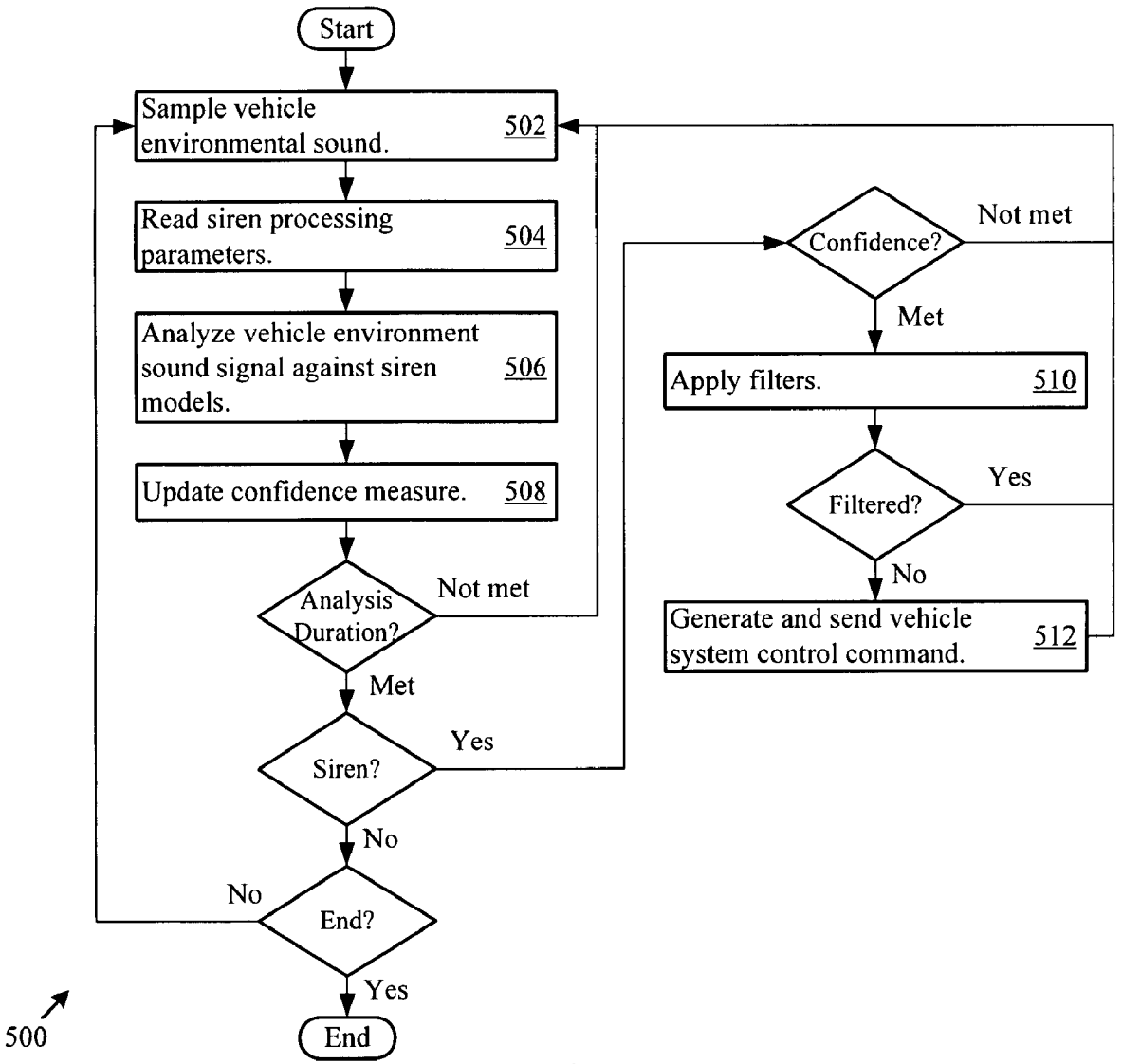
FIG. 5 shows processing flow for a dynamic siren detection and notification system.

FIG. 5 shows processing flow 500 for the system 400. The siren processing program 436 samples the vehicle environmental sound using, for example, a microphone in the vehicle compartment (502). The siren processing program 436 also reads the siren processing parameters 438 (504). Using the vehicle environment sound signal 434 obtained by sampling the vehicle environment sound, the siren processing program 436 analyzes sounds in the vehicle against the siren models 428-430 (506). The analysis may proceed in many different manners. In one implementation, the siren processing program correlates time or frequency content present in the vehicle environment sound signal 434 against each siren model 428-430. Other signal comparison and matching techniques (e.g., spectrogram template matching) may be employed additionally or alternatively. The correlation over time updates a confidence measure (508), such as a degree of correlation between the discrete coefficient vector 432 and the vehicle environment sound signal 434. The analysis and updating of the confidence measure may extend over the analysis duration 442 established by the siren processing parameters 438. If no siren is detected the siren processing program 436 continues to sample the vehicle environmental sound and analyze the sound for sirens.

On the other hand, if the siren processing program 436 detects a siren, the siren processing program may then determine whether the confidence measure meets or exceeds the confidence level 440 established in the siren processing parameters 438. If the confidence threshold is met, the siren processing program 436 may also apply one or more of the command decision filters 446 (510). If a siren is detected with the requisite confidence level and no command decision filter blocks sending a control command, then the siren processing program 436 may proceed by generating and sending a selected vehicle system control command (510). For example, the siren processing program 436 may send a Reduce Volume vehicle system control command to reduce the level of ambient noise in the vehicle cabin, thereby making the siren more noticeable.

Figure 6:
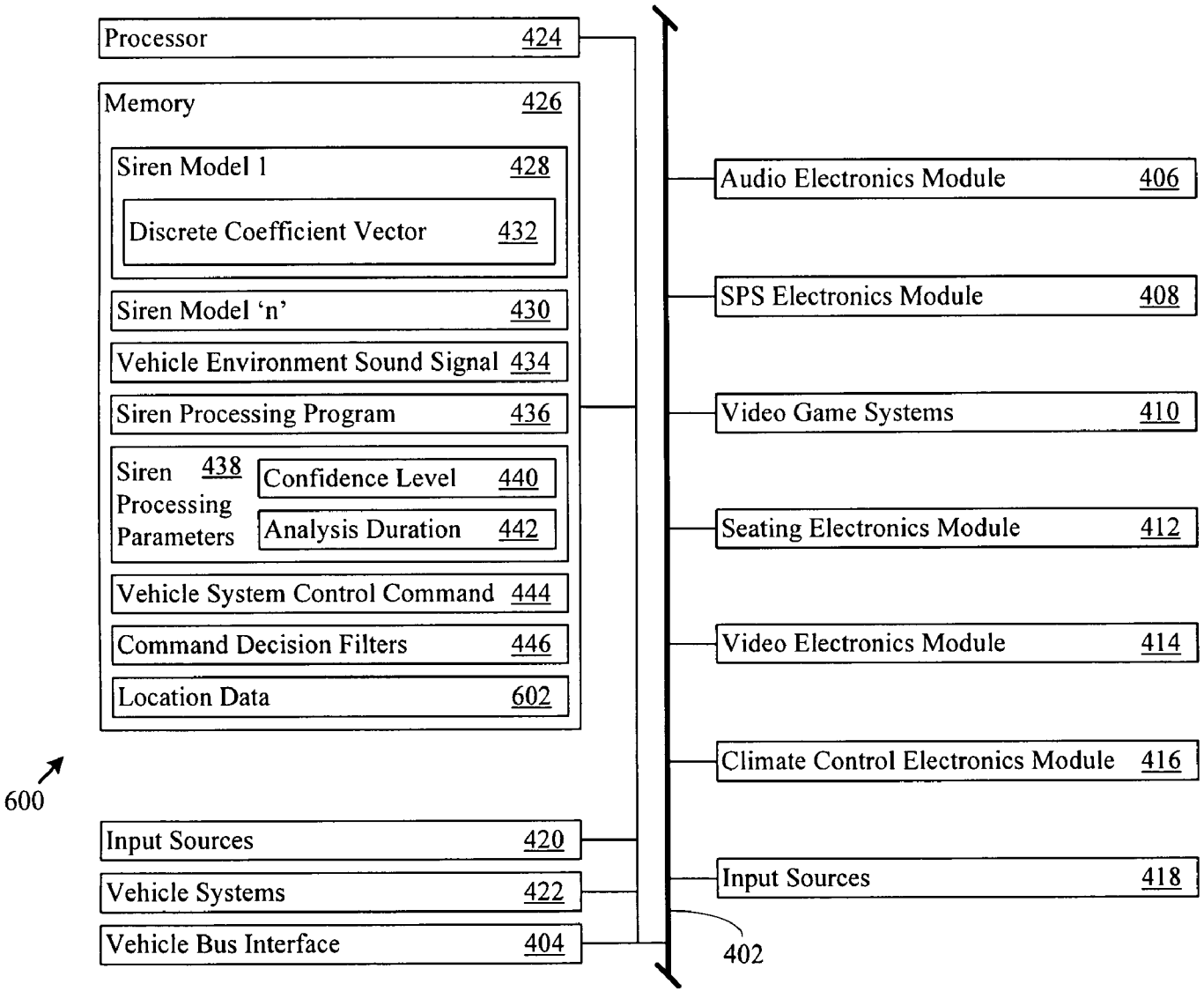
FIG. 6 shows a siren detection and notification system.

FIG. 6 shows a dynamic siren detection and notification system 600 ("system 600"). The system 600 maintains location data 602 in the memory 426. The location data 602 may originate from many different sources. For example, the SPS electronics module 408 may supply vehicle location information to the system 600 over the vehicle bus 402. Alternatively or additionally, a dead reckoning or directly connected positioning system may communicate the location data 602 to the system 600.

Figure 7:
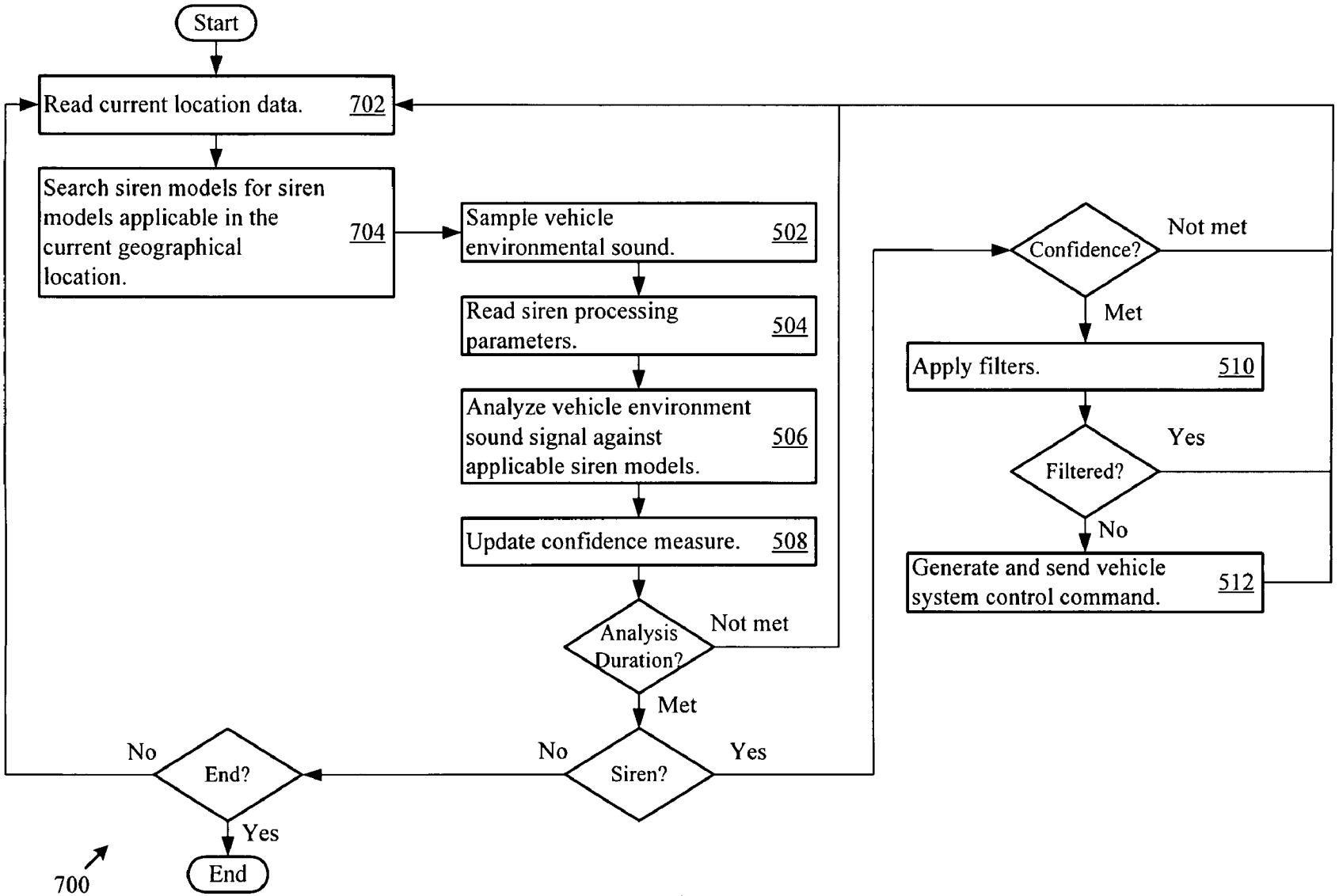
FIG. 7 shows processing flow for a dynamic siren detection and notification system.

FIG. 7 shows processing flow 700 for the system 600. The siren processing program 436 may take the location data 602 into consideration when analyzing whether or not a siren sound exists in the environment. The siren processing program 436 reads the location data 602 which gives the current geographical location of the vehicle (702). The siren processing program 436 may then search the memory 426 for siren models applicable in the current geographical location (704). As noted above, the siren models may include a geographical location identifier to tag the siren model with one or more geographical locations in which the siren model applies. The siren processing program 436 proceeds with its analysis of the specific siren models applicable for the current geographical location. As the vehicle continues travel, the siren processing program 436 may repeatedly check the current location data and identify the applicable siren models given the continually changing position of the vehicle.

Figure 8:
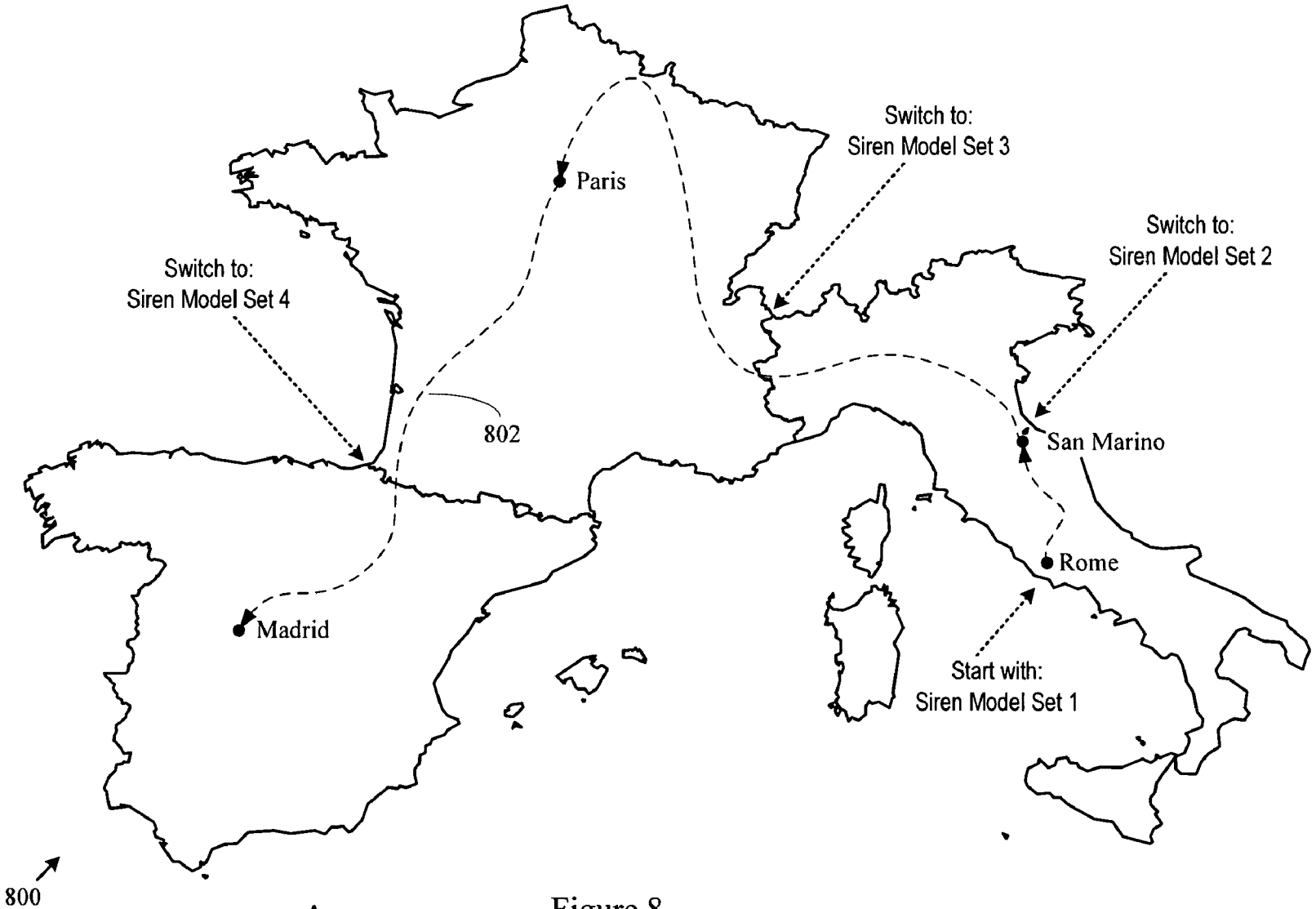
FIG. 8 shows a map and a route through different geographic regions.

FIG. 8 shows a map 800 and a route 802 through different geographic regions. A driver starts in Rome, Italy. The location data 602 locates the vehicle in Rome and the siren processing program 436 responsively begins analyzing vehicle environmental sound data against the siren models that apply for Rome. As the vehicle moves to San Marino, the location data 602 updates accordingly. The siren processing program 436 recognizes that the vehicle has entered the San Marino geographical area by checking the location data 602 and checks the siren models to determine whether any special siren models are applicable. In response, the siren processing program 436 may switch to a set of siren models applicable for San Marino or may make no change with regard to the currently applicable set of siren models.

As the vehicle continues on toward Paris, the vehicle eventually crosses the border between Italy and France. The satellite positioning system in the car updates the location data 602 on a regular basis. Accordingly, the siren processing program 436 may monitor the location data 602 and determine that the vehicle has crossed the border into France. As with any change in vehicle location, the siren processing program 436 may continue to check the current location against the siren models to determine which siren models are applicable in the current geographical area. Thus, if a different set of siren models is applicable in France, the siren processing program 436 may switch to analysis of the siren models that apply. Similarly, as the vehicle moves from France into Spain, the location data 602 reflects the change and the siren processing program 436 may determine whether a different set of siren models is applicable. The siren processing program 436 proceeds with analysis using the siren models applicable for the current graphical location.

Figure 9:
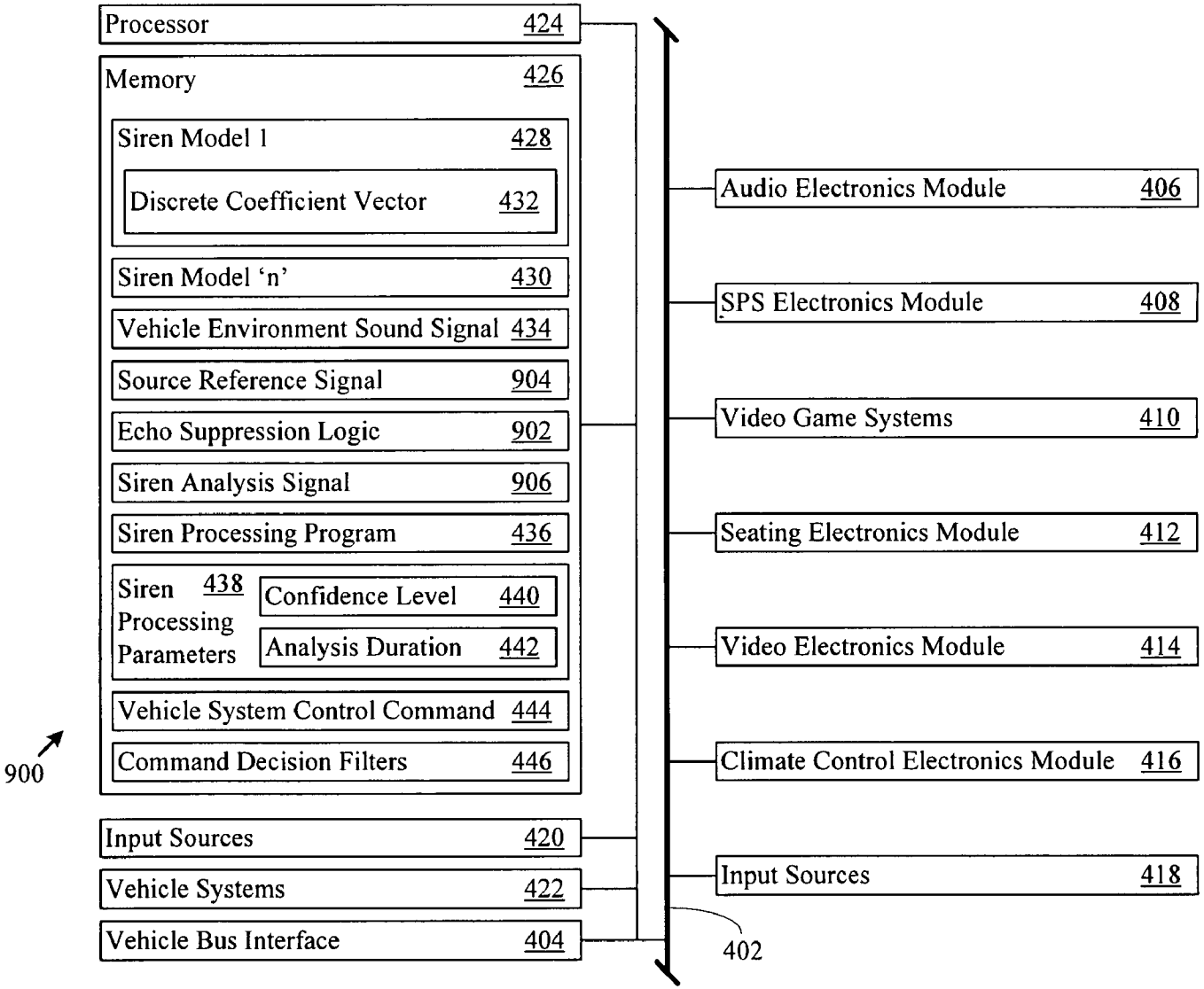
FIG. 9 shows a siren detection and notification system.

FIG. 9 shows a dynamic siren detection and notification system 900 ("system 900"). The system 900 includes echo suppression logic 902. The echo suppression logic 902 may obtain a source reference signal 904 from any of the vehicle electronics modules prior to audible reproduction. As examples, the source reference signal 904 may be a stereo, DVD, or audio signal from any other source prior to application to a transducer that converts the audio signal to sound.

The echo suppression logic 902 may identify similarities or differences between the source reference signal and the vehicle environment sound signal 434. The echo suppression logic 902 may also dampen or cancel the similarities to obtain a siren analysis signal 906 that is an echo-suppressed version of the vehicle environment sound signal 434. Alternatively, separate noise cancellation logic may provide an echo-suppressed vehicle environment signal as a siren analysis signal 906 to the system 900 for processing. The echo suppression logic 902 may be implemented using a coherence processor and a cancellation processor as described in U.S. patent application Ser. Nos. 11/771,258 and 90/916,493, or using other echo cancellation or suppression techniques.

Music, video content, or other multimedia content sometimes includes siren sounds. One benefit of employing the echo suppression logic 902 is that the siren sounds (and other reference sounds) are suppressed or removed from the vehicle environment sound signal 434 prior to analysis against the siren models 428-430. As a result, the system 900 reduces the chances of false positive siren detections caused by multimedia content playing in the vehicle.

Figure 10:
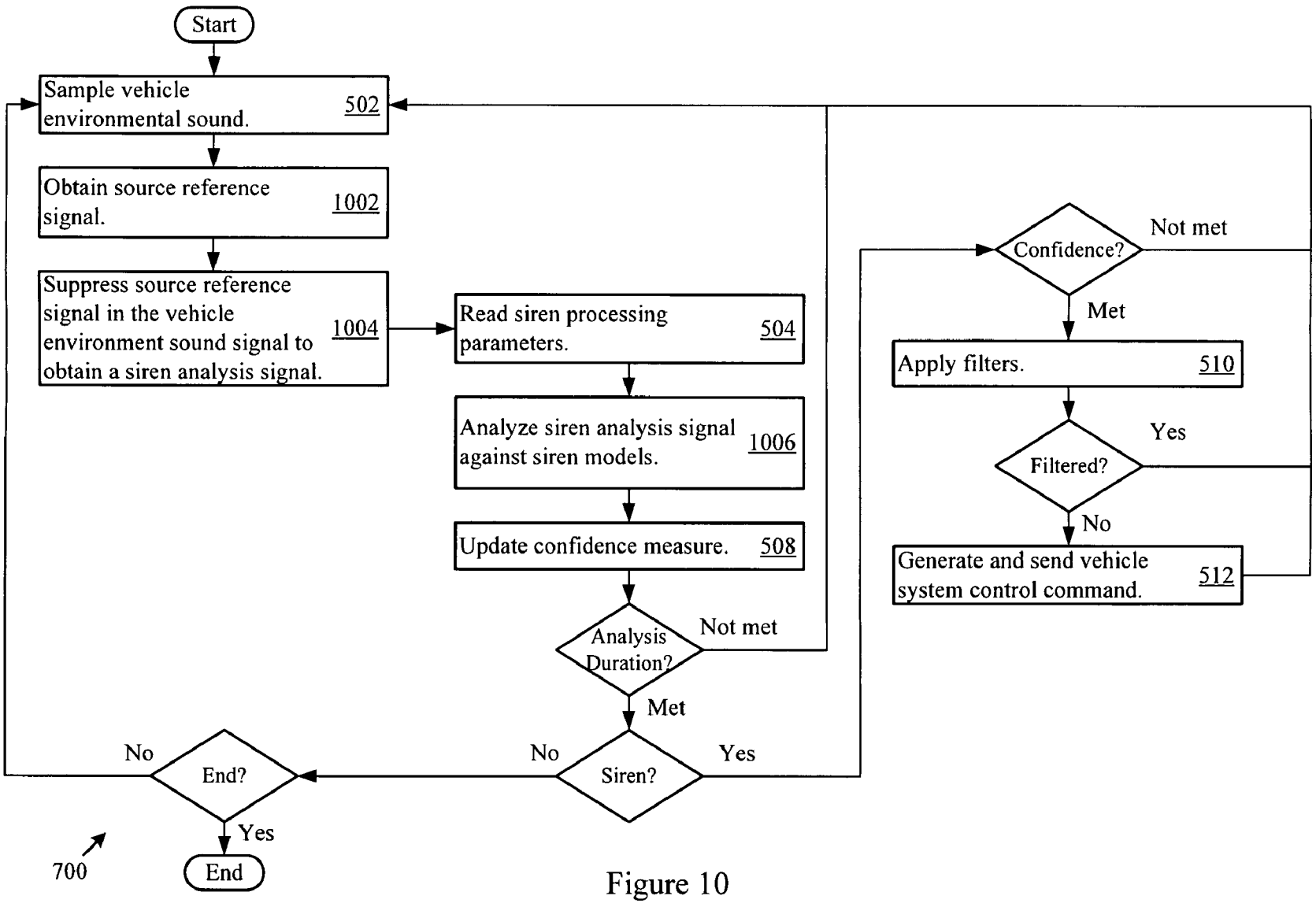
FIG. 10 shows processing flow for a dynamic siren detection and notification system.

FIG. 10 shows processing flow for the system 900. The siren processing program 436 operates in conjunction with the echo suppression logic 902. To that end, the echo suppression logic 902 obtains a source reference signal 904 (1002). The echo suppression logic 902 also suppresses all or part of the source reference signal 904 in the vehicle environment sound signal 434 to obtain a siren analysis signal 906 (1004). The siren processing program 436 proceeds generally as noted above, and executes its analysis against the siren analysis signal (1006).

The systems 400, 600, and 900 may also implement operator configurability. In that regard, the systems may accept input from any input source (e.g., the input source 418 or 420) and responsively modify, add, or remove selected processing parameters for the siren detection techniques. The systems may permit or deny changes to any particular parameter.

As one example, the input source 420 may include a circular controller such as a trackball or rotating knob, and selectable keys that the operator manipulates to choose from system generated and displayed menus and lists of siren processing parameters. The system may then query the operator for a configuration input that specifies a new setting of the chosen processing parameter, that selects from specific prestored parameter values or setting, that activates or deactivates a parameter, or that specifies other actions. In this way, the operator may set, select, or change a wide range of different parameters. Additionally or alternatively, the system may include a service connector, ordinarily inaccessible to the owner of the vehicle, through which authorized service centers may connect to the systems and add, change, delete, set, activate, or deactivate parameters.

Specific examples include setting a relative or absolute volume attenuation amount for the 'Reduce Volume' command; activating or deactivating command decision filters such as the 'Hands-Free' filter; selecting which vehicle system control commands to send when a siren is detected (e.g., send a Reduce Volume command, an Activate Seat Vibration command, and an Illuminate Indicator command); setting the type of indicator (e.g., a message on a display, or lighting a warning light) or audible announcement, specifying the announcement content, volume level, duration of display, or number of repetitions of announcement. Additional examples include activating or de-activating the siren detection processing program; specifically activating or selecting the currently applicable geographical siren models; uploading new siren models (which may be read from an attached stored device, such as a USB flash drive, or read from a CD or DVD); activating or deactivating the echo suppression logic 902 or the location based analysis for choosing geographically applicable siren models; and setting the confidence level 440 and/or analysis duration 442.

The systems may be implemented in many different ways. For example, although some features are shown stored in computer-readable memories (e.g., as logic implemented as computer-executable instructions or as data structures in memory), all or part of the system, logic, and data structures may be stored on, distributed across, or read from other machine-readable media. The media may include hard disks, floppy disks, CD-ROMs, a signal, such as a signal received from a network or received over multiple packets communicated across the network. The systems may be implemented in software, hardware, or a combination of software and hardware.

Furthermore, the systems may be implemented with additional, different, or fewer components. As one example, a processor or any other logic may be implemented with a microprocessor, a microcontroller, a DSP, an application specific integrated circuit (ASIC), program instructions, discrete analog or digital logic, or a combination of other types of circuits or logic. As another example, memories may be DRAM, SRAM, Flash or any other type of memory. The systems may be distributed among multiple components, such as among multiple processors and memories, optionally including multiple distributed processing systems. Logic, such as programs or circuitry, may be combined or split among multiple programs, distributed across several memories and processors, and may be implemented in or as a function library, such as a dynamic link library (DLL) or other shared library.

While various embodiments of the system have been described, it will be apparent to those of ordinary skill in the art that many more embodiments and implementations are possible within the scope of the invention. Accordingly, the invention is not to be restricted except in light of the attached claims and their equivalents.

What is claimed is:

1. A siren detection and notification system comprising:
a vehicle bus interface;
a memory comprising:
a siren model;
a vehicle environment sound signal;
echo suppression logic operable to:
obtain a source reference signal prior to an audible reproduction;
suppress the source reference signal in the vehicle environment sound signal to obtain a siren analysis signal; and
a siren processing program operable to:
analyze the siren analysis signal with respect to the siren model to determine whether a siren sound is detected in the siren analysis signal; and
issue a vehicle system control command over the vehicle bus interface when the siren sound is detected in the siren analysis signal; and
a processor coupled to the memory and the vehicle bus interface that executes the siren processing program.

2. The system of claim 1, where:
the vehicle system control command comprises an audio system control command.

3. The system of claim 2, where:
the audio system control command comprises an entertainment system volume attenuation command.

4. The system of claim 1, where:
the vehicle system control command comprises a siren announcement command.

5. The system of claim 1, where:
the vehicle system control command comprises a siren announcement command and an entertainment system volume attenuation command.

6. The system of claim 1, where the siren model comprises:
a discrete coefficient vector that parameterizes a siren waveform.

7. The system of claim 1, where the memory further comprises:
a confidence threshold; and where:
the siren processing program is further operable to:
determine a confidence measure based on analysis of the siren analysis signal against the siren model; and
issue the vehicle system control command over the vehicle bus interface when the siren sound is detected in the siren analysis signal and when the confidence measure exceeds the confidence threshold.

8. The system of claim 1, where the memory further comprises:
an analysis duration; and where:
the siren processing program is further operable to:
analyze the siren analysis signal against the siren model for at least the analysis duration to detect whether a siren sound is present in the siren analysis signal; and
issue the vehicle system control command over the vehicle bus interface when the siren sound is detected in the siren analysis signal.

9. A siren detection and notification system comprising:
a memory comprising:
a first geographical location siren model;
a second geographical location siren model;
a vehicle environment sound signal;
a vehicle location; and
a siren processing program operable to:
analyze the vehicle location to select between the first and second geographical location siren models, thereby obtaining a selected geographical location siren model;
analyze the vehicle environment sound signal with respect to the selected geographical location siren model to detect whether a siren sound is present in the vehicle environment sound signal; and
issue a siren detection notification when the siren sound is detected in the vehicle environment sound signal; and
a processor coupled to the memory and a vehicle bus interface that executes the siren processing program.

10. The system of claim 9, where at least one of the first and second geographical location siren models comprises:
a discrete coefficient vector that parameterizes a siren waveform.

11. The system of claim 9, where the memory further comprises:
a confidence threshold; and where:
the siren processing program is further operable to:
determine a confidence measure based on analysis of the vehicle environment sound signal with respect to the selected geographical location siren model; and
issue the siren detection notification when the siren sound is detected in the vehicle environment sound signal and when the confidence measure exceeds the confidence threshold.

12. The system of claim 9, where the memory further comprises:
an analysis duration; and where:
the siren processing program is further operable to:
analyze the vehicle environment sound signal with respect to the selected geographical location siren model for at least the analysis duration to detect whether a siren sound is present in the vehicle environment sound signal; and
issue the siren detection notification when the siren sound is detected in the vehicle environment sound signal.

13. The system of claim 9, further comprising:
a vehicle location input in communication with the processor.

14. The system of claim 13, where the vehicle location input comprises a satellite positioning system location input.

15. The system of claim 9, where:
the siren processing system is further operable to:
issue a vehicle system control command when the siren sound is detected in the vehicle environment sound signal.

16. The system of claim 15, where:
the vehicle system control command comprises a volume attenuation command.

17. A siren detection and notification system comprising:
a signal sensor operable to obtain a vehicle environment sound signal;

a memory comprising:
a siren model;
echo suppression logic operable to:
obtain a source reference signal prior to audible reproduction;
suppress the source reference signal in the vehicle environment sound signal to obtain a siren analysis signal; and
a siren processing program operable to:
analyze the siren analysis signal with respect to the siren model to determine whether a siren sound is detected in the siren analysis signal; and
issue a siren detection notification when the siren sound is detected in the siren analysis signal; and
a processor coupled to the memory and a vehicle bus interface that executes the siren processing program.

18. The system of claim 17, where the memory further comprises:
a confidence threshold; and where:
the siren processing program is further operable to:
determine a confidence measure based on analysis of the siren analysis signal with respect to the siren model; and
issue the siren detection notification when the siren sound is detected in the siren analysis signal and when the confidence measure exceeds the confidence threshold.

19. The system of claim 17, where the memory further comprises:
an analysis duration; and where:
the siren processing program is further operable to:
analyze the siren analysis signal with respect to the siren model for at least the analysis duration to detect whether a siren sound is present in the siren analysis signal; and
issue the siren detection notification when the siren sound is detected in the siren analysis signal.

20. The system of claim 17, where:
the siren processing system is further operable to:
issue a vehicle system control command when the siren sound is detected in the siren analysis signal.

21. The system of claim 20, where:
the vehicle system control command comprises a volume attenuation command.

22. A siren detection and notification system comprising:
a vehicle bus interface;
a memory comprising:
a first geographical location siren model;
a second geographical location siren model;
a vehicle environment sound signal;
a vehicle location; and
a siren processing program operable to:
analyze the vehicle location to select between the first and second geographical location siren models, thereby obtaining a selected geographical location siren model;
analyze the vehicle environment sound signal with respect to the selected geographical location siren model to detect whether a siren sound is present in the vehicle environment sound signal; and
issue a vehicle system control command over the vehicle bus interface when the siren sound is detected in the vehicle environment sound signal; and
a processor coupled to the memory and the vehicle bus interface that executes the siren processing program.

23. The system of claim 22, where the memory further comprises echo suppression logic operable to:
obtain a source reference signal prior to audible reproduction; and
suppress the source reference signal in the vehicle environment sound signal.

* * * * *